United States Patent [19]

Dickson

[11] Patent Number: 4,913,220

[45] Date of Patent: Apr. 3, 1990

[54] APPARATUS AND METHOD FOR SPILL CHILLING RAPIDLY SOLIDIFIED MATERIAL

[75] Inventor: James Dickson, Stirling, N.J.

[73] Assignee: Dickson Enterprises, Inc., Sterling, N.J.

[21] Appl. No.: 291,312

[22] Filed: Dec. 27, 1988

Related U.S. Application Data

[63] Continuation of Ser. No. 107,275, Oct. 9, 1987, abandoned.

[51] Int. Cl.[4] ..... B22D 11/06; B22D 27/02

[52] U.S. Cl. ..... 164/463; 164/469; 164/471

[58] Field of Search ..... 164/462, 463, 423, 429, 164/469, 479, 471, 493-495, 506-508, 512-514

[56] References Cited

U.S. PATENT DOCUMENTS

| | | | |
|---|---|---|---|
| 4,157,729 | 6/1979 | Patton et al. | 164/463 |
| 4,257,830 | 3/1981 | Tsuya et al. | 164/463 |
| 4,582,116 | 4/1986 | Ray et al. | 164/463 |
| 4,612,973 | 9/1986 | Whang | 164/423 |

FOREIGN PATENT DOCUMENTS

| | | | |
|---|---|---|---|
| 0147912 | 7/1985 | European Pat. Off. | 164/463 |

*Primary Examiner*—Kuang Y. Lin

*Attorney, Agent, or Firm*—Michael J. Weins; Janine J. Weins

[57] ABSTRACT

The present invention is directed to a method and the associated apparatus for producing rapidly solidified materials by spill chilling. The feed stock can include any of a variety of materials including a high melting point and reactive materials, as well as conventional iron, aluminum, copper and transition base commercially available alloys. A support surface is provided for the solid feed material. Means are provided for both globally and locally heating the feed material. The heating means can include resistant heaters, induction heaters, arcs, electron beam and plasma heaters. A focused energy source such as an electron beam, a laser beam, ion beam or an electric arc can be provided for locally heating the material. The molten feed material is spill chilled onto a moving chill surface. The moving chill surface can be in the form of a continuous belt or the rim of a rotating wheel. It is preferred that the chill surface be cooled and it is further preferred that cooling be provided to the side of the surface which is contacted by the spilled material. In a preferred embodiment means for replenishing the feed material and means for advancing the feed material into the pool so that it will continuously spill onto the moving chill surface are supplied.

6 Claims, 2 Drawing Sheets

APPARATUS AND METHOD FOR SPILL CHILLING RAPIDLY SOLIDIFIED MATERIAL

This application is a continuation application of Ser. No. 107,275, filed Oct. 9, 1987 and now abandoned.

FIELD OF INVENTION

The present invention relates to an apparatus for producing rapidly solidified materials and to a method using the apparatus.

BACKGROUND ART

Rapidly solidified materials are formed by cooling materials so rapidly the kinetic processes responsible for the structure and/or phase distributions associated with prior art commercially produced materials are suppressed. The structure of rapidly solidified materials may be amorphous, microcrystalline or a combination thereof. Because of the fine structure and the suppressed phase transformations many rapidly solidified materials have improved magnetic, electric, mechanical and/or corrosion properties when compared to materials of the same chemistry produced using conventional prior art techniques.

The demand for rapidly solidified materials has grown as their unique properties are identified and components are designed to utilize these properties. Because of the improvement in electrical and magnetic properties, motors, generators and transformers smaller in size yet having equivalent or better performance than their conventional counter part can be made through the appropriate utilization of components made from, or coated with, rapidly solidified materials. Because of increased corrosion resistance, parts with sharp edges, fine details and more resistance to corrosive environments can be formed and made from rapidly solidified materials or materials coated with rapidly solidified powders.

Although the applications for amorphous and microcrystalline materials have grown significantly in the past decade, the methods of manufacturing such materials has not kept pace. Most rapidly solidified materials are made by a process such as is taught in U.S. Pat. No. 4,389,258 of Dickson et al. entitled METHOD FOR HOMOGENIZING THE STRUCTURE OF RAPIDLY SOLIDIFIED MICROCRYSTALLINE METAL POWDERS. The '258 patent teaches a process whereby molten metal is jet cast onto a chill surface. FIG. 3 of the '258 patent shows a jet caster which includes a quartz crucible with a bottom nozzle. An alloy is melted in the quartz crucible and pressure forces a stream of the molten metal through the nozzle onto the periphery of a rotating chilled wheel.

U.S. Pat. No. 993,904 of Edward alford Strange entitled APPARATUS FOR MAKING METAL STRIPS, FOIL, SHEETS OR RIBBONS teaches a device for maintaining a constant level of molten metal in a vessel which is located in close proximity to a moving cylinder. The vessel is provided with an overflow having a length equal to the width of the strip, sheet or ribbon which is to be produced. Metal overflows from the vessel onto a rotating cylinder.

The present invention is directed to a spill chill process for producing rapidly solidified materials. Using the equipment and method of the present invention, materials with widely varying chemistries, melting temperatures and reactivity can be rapidly solidified. Further the present equipment and method increases the efficiency and reliability with which rapidly solidified materials can be produced.

Using the present invention rapidly solidified materials can be produced from feed materials having different melting points, different thermal conductivities and different electrical properties.

The present technique produces the rapidly solidified amorphous materials and does so through the unique creative application of an improvement on the technology taught in the 1911, '904 patent.

SUMMARY OF INVENTION

It is an object of the present invention to provide an apparatus and a method for producing rapidly solidified materials from high melting point materials.

It is an object of the present invention to provide a method and the apparatus for producing rapidly solidified materials from reactive materials.

It is an object of the present invention to provide a method and the associated equipment for producing rapidly solidified ribbon or filament.

It is an object of the present invention to provide a method and the associated equipment for producing rapidly solidified shard.

It is an object of the present invention to provide a method and the associated equipment for producing rapidly solidified powder.

It is a object of the present invention to provide the equipment and associated apparatus for producing rapidly solidified amorphous ribbon the width of which can be varied at the discretion of the operator.

It is an object of the present invention to provide equipment which can simultaneously produce ribbons of different width utilizing a single casting wheel.

It is an object of the present invention to provide equipment which can be used to rapidly solidify nonmetallic materials.

It is an object of the present invention to produce rapidly solidified materials with a minimum of segregation.

It is an object of the present invention to provide equipment which can be utilized to produce rapidly solidified materials using stock material that does not have high electrical conductivity.

It is an object of the present invention to provide equipment and the associated method for producing rapidly solidified materials from stock material that does not couple with an induction coil.

It is yet another object of the invention to provide equipment that, with minor modifications can be used to produce shard, ribbon or fine powder.

It is yet another object of the invention to provide equipment which can be used to produce rapidly solidified material from stock material that has a relatively high melting point.

It is still another object of the invention to provide a casting wheel which can be used to produce multiple amorphous ribbon segments.

A further object of the present invention is to provide a casting surface which is directly cooled.

It is an object of the present invention to provide equipment and a method for rapidly solidifying material in an inert atmosphere or in a vacuum so as to avoid atmospheric contamination of the material.

Another object of the invention is to prevent crucible contamination by providing rapid solidification equipment which will allow the feed material to be melted in a skulled hearth.

These and other objects of the present invention will become apparent from the following descriptions, figures and claims.

The present invention is directed to a method and the associated apparatus for producing rapidly solidified materials. The apparatus of the present invention provides for the melting and forming of rapidly solidified materials from feed stock. The feed stock can have a variety of forms, including solid, powder, powder compact or liquid.

The feed stock is heated on a support surface or in a support container. At one end of the container or support surface the material is heated to a temperature above the melting point. Melted material is spilled onto a quenching surface. The quench or chill surface is maintained at a sufficiently cool temperature that the material spilled on the surface will be rapidly solidified.

In a preferred embodiment, a casting wheel or a continuous belt is used for the chill surface.

In yet another preferred embodiment the chill surface is contoured to conform to the shape of the crucible from which molten material is spilled. When molten material is spilled from the contoured lip of a crucible onto a contoured chill surface preferably the spill distance across the width of the chill surface is approximately equal. By maintaining an equal spill distance, rapidly solidified material having uniform amorphous or microcrystalline structure and uniform thickness can be produced.

A support surface, or a support container, is provided for the feed material. The form and structure of the support surface is in part a function of the composition and form of the feed stock. When the feed stock is in the form of a solid billet, a simple planar support surface can be used, however if the feed stock is either a powder or a liquid an appropriate containment must be used. Care should be taken in selecting the support surface to assure that interaction between the heated feed stock and the support surface does not occur.

Since the feed stock material will be at a temperature near the melting point at the end of the support surface in closest proximity to the chilled surface, a material resistant to elevated temperature oxidation must be used if the apparatus is operated at an elevated temperature.

Further because feed stock will move relative to the support surface so as to supply material to the chill surface, the support surface should have a low coefficient of friction with respect to the feed stock.

The heating means which vary depending on the character of the feed stock are provided for locally and globally heating the feed stock. Resistant heaters, induction heaters, as well as directed energy beams such as plasma, laser and electron beams are appropriate heating means within the scope of the invention.

Means for monitoring and controlling the temperature of the feed stock are provided. The monitoring means will depend on the material and the temperature and maybe a thermocouple placed at the interface between the feed stock and the support surface, or an optical or infrared pyrometer.

The temperature of the feed stock is preferably maintained between about 0.7 to 0.95 Tm, where Tm is the solidus temperature.

Optionally, water cooling coils are provided to the support surface to extract heat and to provide for more precise control of the temperature and to allow skull melting.

A focused energy source, such as an electron beam, laser beam, ion beam or an electric or plasma arc, can be used to locally heat the feed stock. Local heating can be used for skull melting. Skull melting has an advantage if the feed stock is a reactive material since by locally heating and forming a confined liquid pool, the liquid stock material is in contact only with material of the same chemistry. Thus a reaction between a reactive feed stock and a support structure of a different material will be avoided.

The present method requires that molten feed stock be spilled onto a moving chill surface. The moving chill surface can be in any of a variety of forms, including a continuous belt or the rim of a rotating wheel. The chill surface should be both mechanically and electrically insulated to avoid electrical or vibrational transfer from the molten pool of feed material. Electrical isolation is crucial in the event that the heating source results in producing a current.

In a preferred embodiment, means for advancing the pool so that molten metal will continuously spill onto the moving chill surface are provided. Optionally gravity feed can be used to spill molten material onto the chill surface.

It is preferred that the chill surface be cooled and it is further preferred that cooling be provided to that portion of the surface which is in close proximity to the position at which spilled material impacts the chilled surface.

Preferred configurations for the chill surface of the present invention are a large diameter wheel having a contoured rim or a continuous belt contoured to conform to the crucible are used.

Preferred materials for the chill surface are high conductivity materials such as copper, aluminum, cast iron and noble metal coated substrates. The material selected for the chill surface will depend on the form of the rapidly solidifying material that is to be produced and on the chemistry and temperature of the feed material.

In one preferred configuration the wheel is formed of a series of concentric wheel segments, such wheel segments varying slightly in diameter so that the profile of the circumference of the wheel has a step contour.

In a further preferred embodiment of the present invention wheel segments which can be assembled and disassembled and have different thicknesses are used by placing together different thickness wheel segments. Shard or ribbon of different diameters can be made using the same equipment in different casting operations.

In another preferred embodiment the belt has a series of transverse barriers. The transverse barriers form short length shard segments and provide additional chilling to the molten material.

In another preferred embodiment of the present invention a continuous belt having side dams is provided, a rotating wheel that is internally cooled by water and in addition cooled by a jet of liquid gas which impacts the surface at a point prior to the point at which the spilled material contacts the chill surface.

BEST MODES OF CARRYING THE INVENTION INTO PRACTICE

Figure 1:
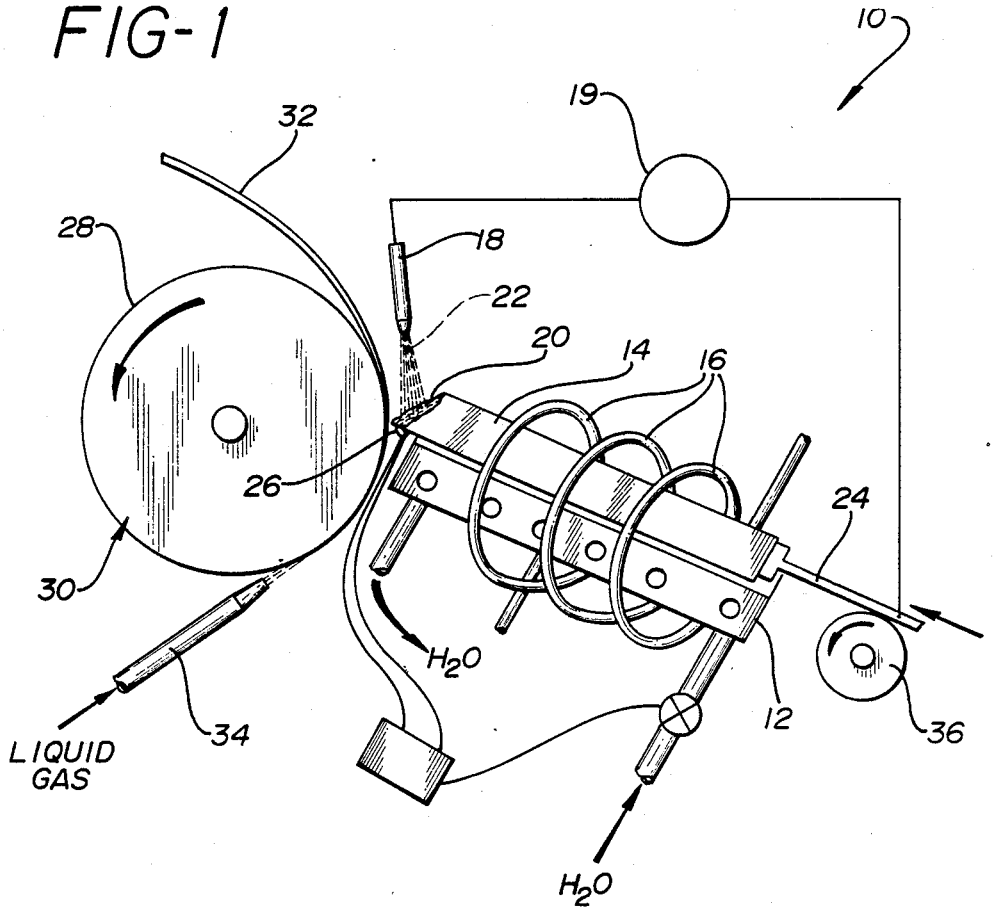
FIG. 1 is a schematic representation of one embodiment of the present invention in which metal, ceramic, polymer, bulk solid or powder feed material is globally heated and locally melted. The feed material is advanced at a rate such that the molten materials a rotating wheel that is internally cooled by water and in addition cooled by a jet of liquid gas which impacts the surface at a point prior to the point at which the spilled material contacts the chill surface.

FIG. 1 is a schematic representation of one embodiment of the present invention. The spill chill equipment 10 is provided with a support surface 12. The support surface 12 cradles the feed material 14. Means such as resistance heaters and induction heating coils 16 provide for globally heating the solid feed material 14. A rotating wheel 30 is internally cooled by water, and in addition cooled by a jet of liquid gas which impacts the surface at a point prior to the point at which the spilled material contacts the chill surface.

Global heating means heat the solid feed material to between about 0.7 and 0.95 of the melting or solidus temperature, Tm. The use of global heating means to maintain the solid feed material at a temperature between 0.7 and 0.9 Tm minimizes the fluctuations in temperatures in the solid and thereby assures more uniform properties of the resulting rapidly solidified material avoiding segregation in the liquid solid interface of the skull and locally melted material to be spilled.

A local energy source 18 is employed to locally raise the feed stock temperature above Tm and thus to provide a molten pool 20. The local energy source can be an arc torch, an arc plasma torch, a laser or an electron beam. A gas torch provides local energy for melting material 14 into 20.

If an arc source 18 as shown in FIG. 1 is used an arc 22 is struck and maintained between the molten material 20. A second electrical contact 24 provides a path through the solid feed material 14 for the current flow or thus the conductor support 12. Current flow through the feed material provides for $I^2R$ heating of the solid feed material 14 or conductive or radiate heating of 14 by the current in 12.

In order to assure that the temperature at the interface between the solid feed material 14 and the support surface 12 is maintained at 0.7 to 0.95 Tm a thermocouple 26 is placed in contact with the surface of the solid feed material 14 near the interface 28 between the feed material 14 and support surface 12.

The thermocouple serves as a control means to assure that the solid material 14 is maintained at a temperature between 0.7 and 0.95 Tm. So maintaining the temperature of the feed stock assures a sharp interface between the molten material 20 and the solid portion of the feed stock 14. The small temperature differential at the interface will remain stable and thus short term fluctuations in temperature at the liquid solid interface will be avoided.

The molten pool of material 20 is spilled into contact with the circumferential rim 28. The spilled material is rapidly solidified by the rim 28 of the chilled wheel 30 to a rapidly solidified ribbon 32.

With respect to preferred materials copper and copper alloys and imparticular OFHC Copper and Copper alloys containing chromium, titanium, zirconium and/or berylium are preferred. Also other high thermal conductivity oxidation resistant noble materials such as TMZ molybdenum, chromium alloys steel and stainless steel. If corrosion oxidation is not a problem a cast iron wheel can be used because of the high thermal conductivity and thermal mass of cast iron. If corrosion is a problem tool steels, and nickel or cobalt alloys can be used. The wheel and/or belt can be formed by coating a material having high thermal conductivity and thermal heat capacity with a material that is noble relative to material that is to be spill chilled.

Since the heat is supplied to the rim 28 during rapid solidification the most effective way of cooling the rim is through direct cooling of the rim 28. Preferably this is accomplished by spraying a liquified gas, such as liquid nitrogen directly onto the rim 28. A nozzle or series of nozzles 34 are used to direct the liquid gas onto the rim 28. The nozzles should be placed to direct the gas as close to the point at which material was spilled onto the wheel as possible. Alternatively the liquid gas can be injected onto the wheel at the point where the ribbon moves away from the wheel thereby increasing the stripping capacity of the wheel. This gives flexibility with respect to the form of the rapidly solidified material since the liquid gas when heated will expand rapidly and cause either gas bubbles to break up the rapidly solidified material or alternatively may cause the rapidly solidified material to float on a vapor layer formed from rapidly heating the liquid gas. The liquid gas assures cooling of the rim 28 while entrapped gas on the surface may cause a discontinuous ribbon shard 32 to be generated. If a rapidly solidified powder is desired the judicious placement of the liquid gas nozzle in combination with a serrated or grooved wheel can be used to form rapidly solidified shard and/or powder. This will reduce the requirement for pulverization of the rapidly solidified ribbon subsequent to production.

The liquid gas will volatilize and aid in shielding the entire system along with the gas introduced if an arc plasma created energy beam is present. The fluids of the volatilized cooling gas may act in the grooves of an etched wheel to form tapes or filaments.

As the molten pool 20 spills onto the moving rim 28, it will be necessary to advance the solid feed material 14. The solid feed material 14 can be advanced manually or by a motor and gear mechanism 36.

In place of the rim of a rotating wheel a continuous belt can be used or alternatively the circumferential area of a flat rotating surface could be used.

Figure 2:
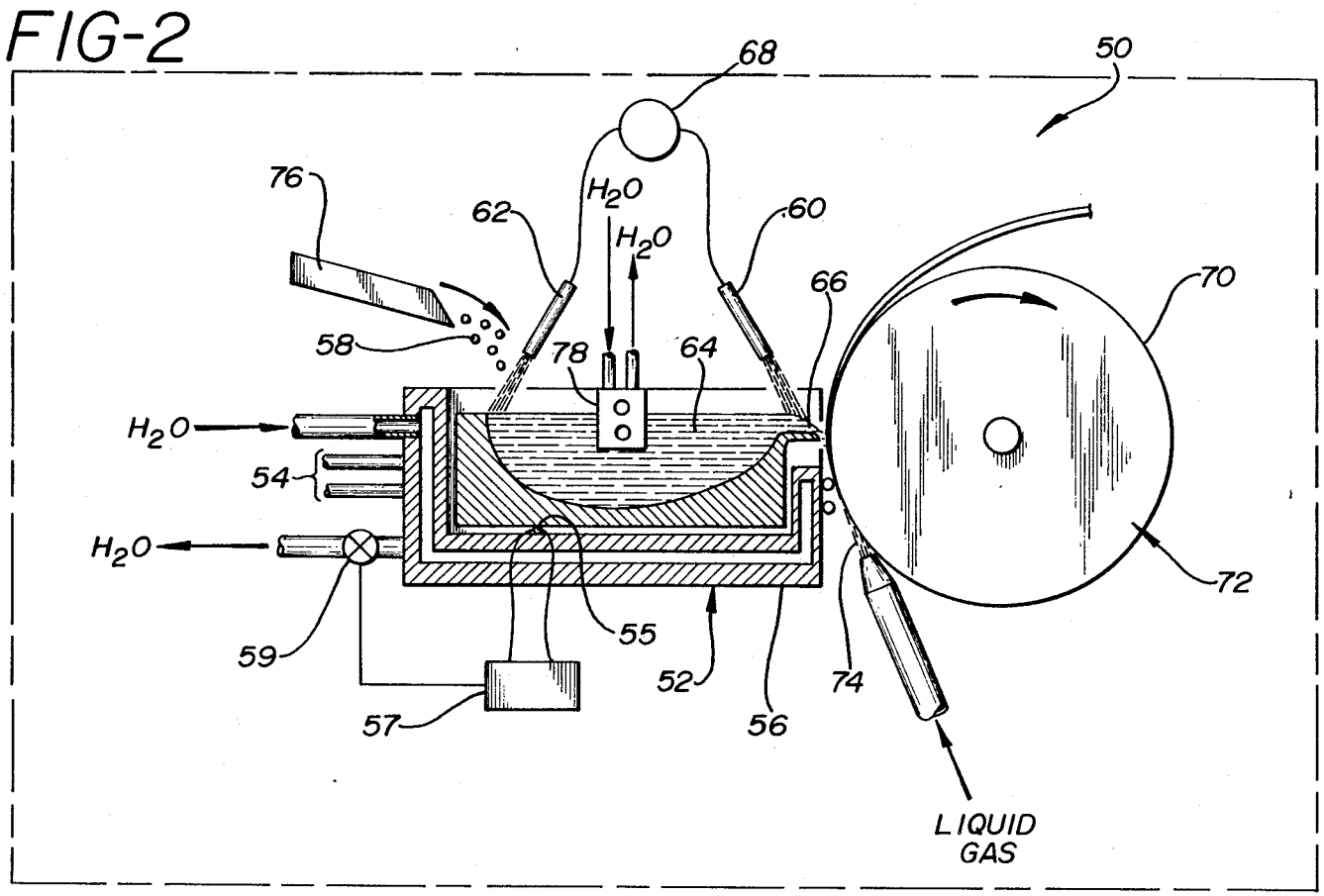
FIG. 2 is a schematic representation of a second embodiment of the present invention. In this embodiment a pool of molten feed material is formed in a skull. Molten material from the skull spills onto the rim of a moving chilled wheel. The molten pool may be fed by solid or liquid material.

FIG. 2 is a schematic representation of a second embodiment 50 of the present invention. In this embodiment the support for solid material is a controlled temperature containment vessel 52. The containment vessel 52 comprises an induction heating unit 54 and water cooled crucible 56. A thermocouple 55 can be used to measure the temperature of the metal crucible interface. The output of the thermocouple 55 is fed to a control circuit 57. The control circuit 57 can control the flow through valve 59. Feed material 58 is placed in the crucible 56.

Local heating is provided by two or more electrodes, a first electrode 60 and the secondary electrodes 62 which are arc torches and create a molten pool 64. The first electrode 60 makes electrical contact with the feed material 58 melting it to form pool 64 for spilling at 66. The secondary electrodes 62 makes electrical contact with the feed material 58 at a distance from 66 and applies heat to feed from hopper 76. A power source 68 is provided for producing a current or arcs. The contour of the molten pool 64 can be altered by movement of the electrodes 60 and 62. The moving surface 70 is the rim of a chilled wheel 72. The rim is cooled by jet 74 of liquid gas which is directed to the rim 70.

As material from the molten pool 64 spills onto the rim the material is rapidly solidified and removed. In a preferred embodiment, in order to avoid contamination of the feed material and/or the rapidly solidified product, the entire apparatus can be maintained in a controlled atmosphere by enclosing the casting apparatus in a vessel which is indicated by the phantom line.

Feed material 58 is replenished by use of a hopper mechanism solid or liquid feed 76. The hopper is provided with control means which regulate flow of material into the crucible. The control means can preferably be connected by means of a level switch to the crucible level. A dam 78 is provided to mitigate turbulance at the spill interface. If the material which is being rapidly solidified has a tendency to oxidize or otherwise pick up scum or pick up the skull or dross the dam can minimize the tendency of the dross to flow into the region of spill.

Figure 3:
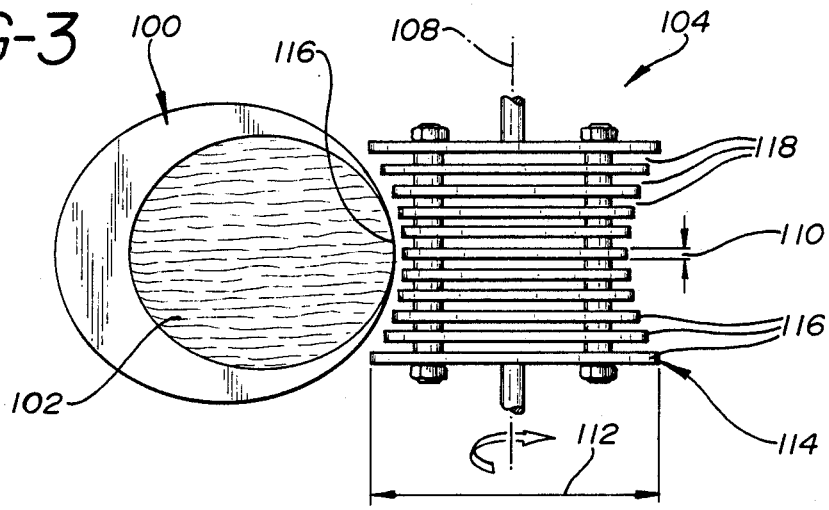
FIG. 3 is a schematic representation of a preferred chilling wheel in accordance with the present invention which has a profile contoured to match the contour of the crucible from which molten material is spilled.

FIG. 3 is a schematic representation of a crucible 100 which spills liquid 102 onto a preferred casting wheel 104 in accordance with the present invention. The casting wheel 104 is constructed of a series of discs 106 which are concentrically stacked about a common axis 108. The discs 106 are arranged by thickness 110 and diameter 112 so as to form a casting wheel 104 having a profile 114 which matches the contour of the lip 116 crucible 100. By forming a casting wheel from disc shape segments a wheel contoured so as to conform to the lip of the crucible supplying the molten metal can be formed. Using the contoured wheel 104 of FIG. 3 in combination with insulating spacers at the interface 118 between the discs allows a series of side by side ribbons to be cast. This product form is of particular advantage when the final product is to be powder.

The present invention has been described in terms of preferred embodiments and particular configurations. Modifications to the apparatus including substitution of material from those suggested in the application can be made by one skilled in the art without departing from the spirit of the invention.

What I claim is:

1. A method for rapidly solidifying a material comprising:

(a) globally heating a feed stock;

(b) controlling the temperature of said feed stock to maintain a temperature of said feed stock at a temperature of between about 0.7 and 0.95 Tm;

(c) locally heating a region of said feed stock to provide a confined substantially horizontal molten pool;

(d) spilling molten material from said substantially horizontal pool onto a moving chill substrate;

(e) maintaining said molten pool by advancing said heated feed stock substantially horizontally.

2. The method of claim 1 further comprising the step of selecting a global heating source for step (b) from the group of energy sources consisting of resistance heaters and induction heaters.

3. The method of claim 1 further comprising the step of selecting a focused energy source for step (c) from the group of energy sources consisting of gas torches, arc torches, plasma torches, and lasers.

4. The method of claim 2 further comprising the step of selecting a focused energy source for step (c) from the group of energy sources consisting of gas torches, arc torches, plasma torches, and lasers.

5. The method of claim 1 further comprising the step of cooling said chill substrate.

6. The method of claim 5 wherein said step of cooling is by directing a stream of liquified gas onto said chill substrate, thereby cooling said substrate.

* * * * *